US011135609B2

(12) United States Patent
Corona et al.

(10) Patent No.: US 11,135,609 B2
(45) Date of Patent: Oct. 5, 2021

(54) MULTI-NOZZLE MULTI-CONTAINER FLUID SPRAY DEVICE

(71) Applicants: Marene Corona, West Jordan, UT (US); Cameron H. Gardner, Sandy, UT (US); Shane York, St. George, UT (US)

(72) Inventors: Marene Corona, West Jordan, UT (US); Cameron H. Gardner, Sandy, UT (US); Shane York, St. George, UT (US)

(73) Assignees: Marene Corona, West Jordan, UT (US); Cameron H. Gardner, Kearns, UT (US)

( * ) Notice: Subject to any disclaimer, the term of this patent is extended or adjusted under 35 U.S.C. 154(b) by 214 days.

(21) Appl. No.: 16/228,743

(22) Filed: Dec. 20, 2018

(65) Prior Publication Data

US 2019/0201926 A1 Jul. 4, 2019

Related U.S. Application Data

(60) Provisional application No. 62/610,930, filed on Dec. 28, 2017.

(51) Int. Cl.

| | |
|---|---|
| ***B05B 11/00*** | (2006.01) |
| ***B05B 1/16*** | (2006.01) |
| ***B05B 7/08*** | (2006.01) |

(52) U.S. Cl.

CPC ..... *B05B 11/3084* (2013.01); *B05B 1/16* (2013.01); *B05B 1/169* (2013.01); *B05B 7/08* (2013.01);

(Continued)

(58) Field of Classification Search

CPC .. B05B 1/16; B05B 1/169; B05B 7/08; B05B 7/1209; B05B 7/1236; B05B 7/2405;

(Continued)

(56) References Cited

U.S. PATENT DOCUMENTS

| | | | |
|---|---|---|---|
| 1,948,401 | A | 2/1934 | Smith |
| 3,269,389 | A | 8/1966 | Meurer |

(Continued)

FOREIGN PATENT DOCUMENTS

| | | |
|---|---|---|
| CN | 107117381 | 9/2017 |
| DE | 69600515 | 4/1999 |

(Continued)

*Primary Examiner* — Ryan A Reis

(74) *Attorney, Agent, or Firm* — Paul C. Oestreich; Eminent IP, P.C.

(57) ABSTRACT

The multi-nozzle multi-container fluid spray device includes multiple, for example, three, containers. Each container may hold a different liquid which the user may dispense simultaneously, in a desired combination, or individually. The containers are connected to each other and to a spray handle and spray head in a reversible manner. The spray head includes multiple nozzles, with each nozzle being designed to independently turn on, off, or to dispense a liquid spray at a desired density of liquid particles. The multiple pumps and hoses may be housed within the spray head. Each of the hoses extends from a single pump into one of the containers. Each pump is designed to dispense a liquid from one of the containers through a single nozzle. If a nozzle is turned off, the pump connected to that nozzle does not dispense liquid from the container with which it is connected.

18 Claims, 10 Drawing Sheets

(52) U.S. Cl.
CPC ..... *B05B 11/0008* (2013.01); *B05B 11/0054* (2013.01); *B05B 11/3011* (2013.01); *B05B 11/3043* (2013.01)

(58) Field of Classification Search
CPC ... B05B 7/2408; B05B 7/2416; B05B 7/2464; B05B 7/2472; B05B 11/0008; B05B 11/0054; B05B 11/3011; B05B 11/3043; B05B 11/3047; B05B 11/3083; B05B 11/3084
See application file for complete search history.

(56) References Cited

U.S. PATENT DOCUMENTS

| | | | | |
|---|---|---|---|---|
| 3,760,986 | A | 9/1973 | Castner | |
| 4,165,812 | A * | 8/1979 | Jennison | B65D 21/0204 215/10 |
| 4,355,739 | A | 10/1982 | Vierkotter | |
| 4,365,751 | A | 12/1982 | Saito | |
| 4,826,048 | A | 5/1989 | Skorka | |
| 4,902,281 | A | 2/1990 | Avoy | |
| 5,009,342 | A | 4/1991 | Lawrence | |
| 5,152,431 | A | 10/1992 | Gardner | |
| 5,152,461 | A | 10/1992 | Proctor | |
| 5,320,845 | A | 6/1994 | Py | |
| 5,370,275 | A | 12/1994 | Mills | |
| 5,433,350 | A | 7/1995 | Graubart | |
| 5,439,141 | A | 8/1995 | Clark | |
| 5,472,119 | A | 12/1995 | Park | |
| 5,535,950 | A | 7/1996 | Barriac | |
| 5,560,545 | A | 10/1996 | Grogan | |
| 5,626,259 | A | 5/1997 | Maas | |
| 5,656,035 | A | 8/1997 | Avoy | |
| 5,683,014 | A * | 11/1997 | Smolen, Jr. | B05B 11/3009 222/137 |
| 5,769,275 | A | 6/1998 | Boehmer | |
| 5,819,987 | A | 10/1998 | Miller | |
| 5,836,479 | A | 11/1998 | Klima | |
| 5,857,591 | A | 1/1999 | Bachand | |
| 5,887,761 | A * | 3/1999 | Foster | B05B 11/007 222/383.1 |
| 5,918,771 | A | 7/1999 | van der Heijden | |
| 5,964,377 | A | 10/1999 | Demarest | |
| 6,082,588 | A | 7/2000 | Markey | |
| 6,299,023 | B1 | 10/2001 | Arnone | |
| 6,341,717 | B2 | 1/2002 | Auer | |
| 6,640,999 | B2 | 11/2003 | Peterson | |
| 6,659,311 | B2 | 12/2003 | Prueter | |
| 6,843,390 | B1 | 1/2005 | Bristor | |
| 6,978,946 | B2 | 12/2005 | Sweeton | |
| 7,021,499 | B2 | 4/2006 | Hansen | |
| 7,195,135 | B1 | 3/2007 | Garcia | |
| 7,222,752 | B2 * | 5/2007 | Ponton | B05B 11/3083 222/134 |
| 7,775,401 | B2 | 8/2010 | Banco | |
| 7,967,220 | B2 | 6/2011 | Hansen | |
| 8,338,354 | B2 | 12/2012 | Williams | |
| 8,616,390 | B2 | 12/2013 | Kountotsis | |
| 9,687,867 | B2 | 6/2017 | Burrowes | |
| 9,706,754 | B2 | 7/2017 | Prescott | |
| D795,082 | S | 8/2017 | Gonzolez | |
| 2001/0025859 | A1 | 10/2001 | Dumont | |
| 2003/0213855 | A1 | 11/2003 | Filicicchia | |
| 2004/0238567 | A1 * | 12/2004 | Bloc | B05B 11/3084 222/135 |
| 2005/0092778 | A1 * | 5/2005 | Bistolfi | B05B 1/341 222/383.1 |
| 2007/0233012 | A1 | 10/2007 | Lerrick | |
| 2007/0254081 | A1 | 11/2007 | Cullen | |
| 2010/0108779 | A1 | 5/2010 | Filsouf | |
| 2010/0282776 | A1 * | 11/2010 | Knopow | B67D 7/005 222/145.1 |
| 2011/0057054 | A1 * | 3/2011 | Dessaint | B65D 81/3288 239/302 |
| 2012/0279990 | A1 | 11/2012 | Werner | |
| 2014/0061233 | A1 | 3/2014 | Lang | |
| 2014/0239094 | A1 | 8/2014 | Munro | |
| 2017/0144178 | A1 | 5/2017 | Deng | |
| 2017/0157632 | A1 | 6/2017 | Alluigi | |
| 2018/0178234 | A1 | 6/2018 | Gonzalez | |
| 2018/0361409 | A1 * | 12/2018 | Beyda | B05B 11/0078 |

FOREIGN PATENT DOCUMENTS

| | | | |
|---|---|---|---|
| DE | 102006029345 | | 12/2007 |
| DE | 202011102452 | | 8/2012 |
| EP | 0379627 | A1 | 8/1990 |
| EP | 0710507 | A2 | 5/1996 |
| EP | 1022061 | A2 | 7/2000 |
| GB | 191504639 | | 1/1916 |
| GN | 102715724 | | 10/2012 |
| WO | 1995/000436 | | 1/1995 |
| WO | 1995/005998 | | 3/1995 |
| WO | 1995/030491 | | 11/1995 |
| WO | 1996/025236 | | 8/1996 |
| WO | 1997/031095 | | 8/1997 |
| WO | 2012/042243 | | 4/2012 |
| WO | 2013/120098 | | 8/2013 |
| WO | 2015/070097 | | 5/2015 |

* cited by examiner

MULTI-NOZZLE MULTI-CONTAINER FLUID SPRAY DEVICE

RELATED APPLICATIONS

This application claims the benefit of U.S. Provisional Patent Application No. 62/610,930, filed Dec. 28, 2017, which is hereby incorporated by reference in its entirety.

BACKGROUND

Field of the Invention

This disclosure relates to fluid delivery devices and containers including fluid spray bottles.

Background of the Invention

A variety of industries use bottles and other containers to store fluids and deliver them in the form of a spray nozzle or nebulizer. These industries include, but are not limited to, household cleaning, automotive, lawn and garden, medical, beauty and cosmetics, dental, and any market which utilizes trigger spray bottles.

Often tasks require multiple solutions requiring the user to manage multiple containers which may be inconvenient for the user. For example, a task may require the use of three different solutions which must be applied sequentially and possibly within a short time period of each other. In this scenario, the user must carry three separate bottles to the location where the task will be performed and move between the use of each bottle. A single container which could store, yet keep separate, the multiple solutions and deliver each separately or in a defined combination would be more convenient for the user.

In addition, the user must store three separate containers between uses. A single container which stores multiple fluids in separate compartments would require less storage space.

Furthermore, when multiple fluids are supplied in separate containers, each container results in a separate piece of waste in a landfill. A container which stores separate fluids in refillable compartments may reduce the amount of waste and negative impact on the environment.

BRIEF SUMMARY OF THE INVENTION

We disclose a multi-nozzle multi-container fluid spray device which includes a plurality of containers, each of which may each hold a different fluid. The multi-nozzle multi-container fluid spray device may include a single spray head with a single trigger in connection with a plurality of pumps. In an example, the pumps may include one or more reciprocating piston pumps. The spray head may also include a plurality of nozzles. Each of the plurality of pumps may include a proximal end in mechanical connection with a back pressure plate. In some embodiments, the back pressure plate may be pressure locked over the proximal end of each pump. The back pressure plate may include a plurality of orifices through which the proximal ends of the pumps may be slideably inserted and attached to the back pressure plate by connectors.

The plurality of nozzles may be in fluid communication with a distal end of each of the plurality of pumps with a front plate disposed between the nozzles and the distal ends of the pumps. Each of the plurality of nozzles may be independently turned to an "on" or an "off" position.

The multi-nozzle multi-container fluid spray device may include a plurality of hoses, each in communication with one of the pumps and extending into one of the plurality of containers.

The multi-nozzle multi-container fluid spray device may include a container release device which may be reversibly connected to the top of each of the plurality of containers. The container release device may include a container release housing. The container release housing may include a plurality of walls which may partially define a plurality of orifices. A container may be inserted into each orifice. A lip may be disposed at the lower edge of each of the plurality of walls. A container may be inserted into each orifice and the lip may snap over the top of the container thereby holding the container in place. A release clip may also partially define each of the orifices. Each release clip may also snap over the top of one of the containers.

The container release device may also include a plurality of push buttons which may, in turn, be in mechanical connection with a plurality of release bars. Each of the plurality of release bars may be in mechanical connection with one of the plurality of release clips. In some embodiments, the container release device includes a spring-loaded mechanism. By pushing one of the push buttons, the release bar connected to it may, in turn, apply pressure to the adjacent release clip. The release bar may push the release clip outward, reversibly expanding the orifice. The container may slip out of the orifice and the release clip may return to its original position.

In some embodiments, the multi-nozzle multi-container fluid spray device is a triple-nozzle spray container. In an example, some embodiments include three containers. In an example, some embodiments include, three pumps, three hoses, and three nozzles. In an example, the back pressure plate may be triangular in shape. In an example, the container release mechanism includes three push buttons.

The plurality of containers may be reversibly connected to each other. For example, they may be interlocking through a mechanism which may include interlocking male and female notches. The opening of each of the containers may be covered by a seal. Each seal may comprise a hose receptacle through which one of the plurality of hoses may be reversibly inserted.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings.

DETAILED DESCRIPTION OF THE INVENTION

Definitions

Figure 1:
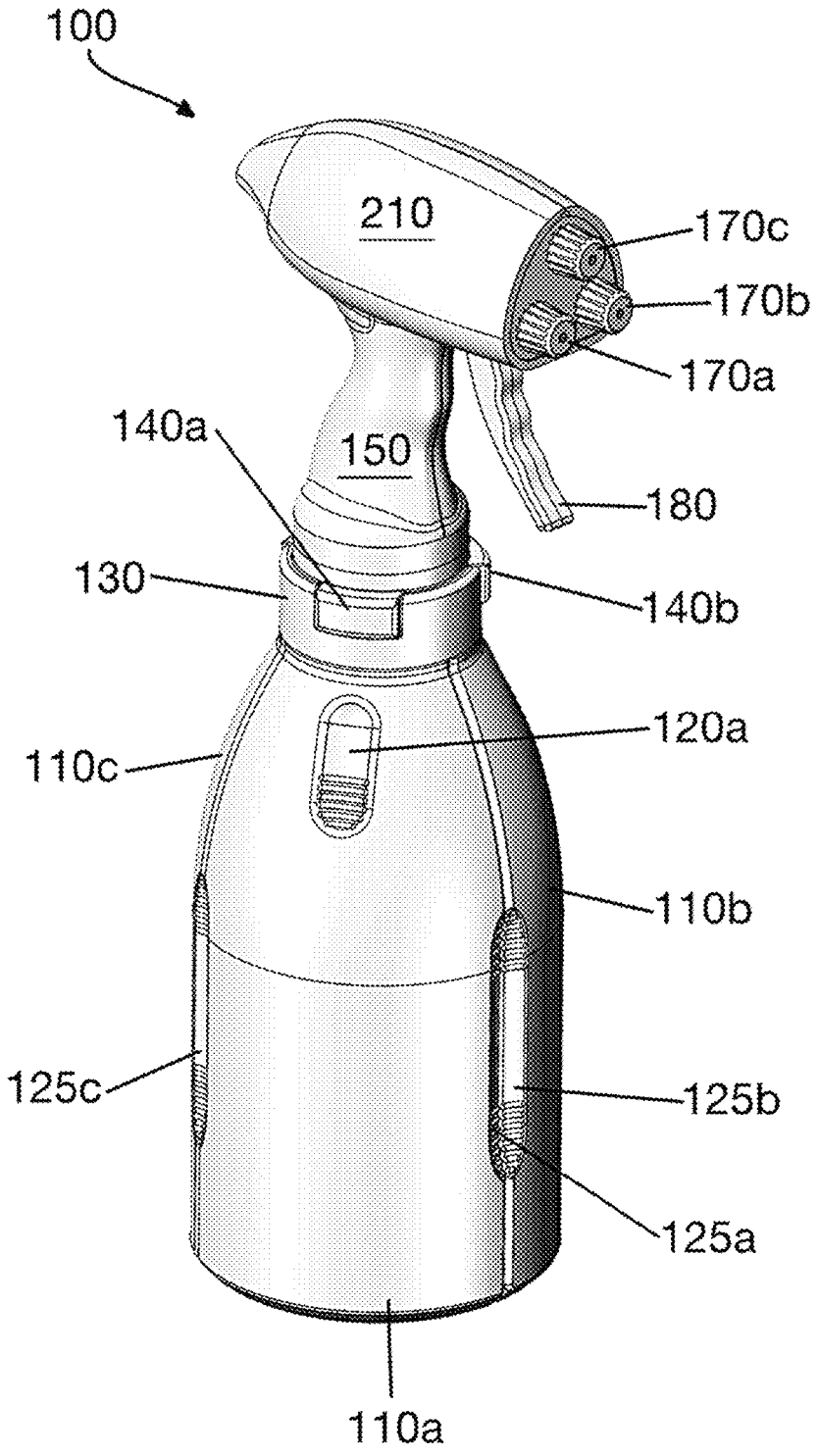
FIG. 1 is a perspective view of a multi-nozzle spray bottle according to an embodiment of the disclosure.

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure, and are not meant to be limiting in any fashion. Nor do these phrases indicate any kind of preference for the disclosed embodiment.

While this invention is susceptible of embodiment in many different forms, there are shown in the drawings, which will herein be described in detail, several specific embodiments with the understanding that the present disclosure is to be considered as an exemplification of the principals of the invention and is not intended to limit the invention to the illustrated embodiments.

The disclosed multi-nozzle multi-container fluid spray device solves the problem of needing multiple containers of different liquid spray solutions by combining multiple containers into one device thus providing a flexible tool for the user. It also reduces waste which may fill landfills by providing a mechanism to refill each container. The disclosed multi-nozzle multi-container fluid spray device is also more convenient for the user and saves time, money, and resources.

The disclosed multi-nozzle multi-container fluid spray device includes multiple containers which may each hold a different liquid. The containers may be bottles, tubes, sleeves, flasks, jars, packets, cans, drums, or any container known in the art which may hold a liquid. In an example, the multi-nozzle multi-container fluid spray device includes two, three, four, five, or six containers.

Each of the multiple containers may be reversibly connected to another container. In the example in which the plurality of containers includes three containers, each container is reversibly connected to two other containers.

The multiple containers may be reversibly connected by being interlocking with each other. In an example, the containers may each include one or more male notches and one or more female notches. A male notch of one container may insert into the female notch of one or more adjacent containers.

Each of the containers may include a top rim which defines an opening. In some embodiments, the top rim of one or more of the containers is covered by a seal. Each seal may include a hose receptacle. The hose receptacles may be constructed of an easily perforated material through which the end of a hose extending from the spray head may extend. In an example, the hose receptacles may be constructed of foil, wax paper, or plastic.

The containers may be disposable, replaceable, or refillable. They may be constructed of a recyclable material. In some embodiments, the containers are constructed of glass, one or more plastic polymers, foil, recyclable material, biodegradable material, paper, wax paper, or hemp plastic.

In some embodiments, the containers include finger indentations onto which a user may place his or her finger to aid in gripping the multi-nozzle multi-container fluid spray device during use. Similarly, thumb indentations may be included on the containers. In some embodiments, the finger and thumb indentations include ridges to further improve gripping. The containers may have curved or custom-molded lines to fit into the user's hand comfortably during use.

The multi-nozzle multi-container fluid spray device may include a spray head which is in mechanical connection with each of the plurality of containers. The spray head may include a plurality of nozzles. Some embodiments may include the same number of nozzles as containers. Each nozzle may be independently turned to an "off" position while the other nozzles may be open and available to dispense fluid. In some embodiments, each nozzle may be selected from the following list: a plain-orifice nozzle, a shaped-orifice nozzle, a surface-impingement single-fluid nozzle, a spiral spray nozzle, a pressure-swirl single-fluid spray nozzle, a spillback nozzle, and a solid-cone single-fluid nozzle. In some embodiments, one or more of the nozzles may be adjustable and able to deliver a range of densities of fluid particles by passing the fluid through a region of a mesh which includes different regions with different size pores.

The multiple nozzles may each be connected to a first side a front plate. A second side of the front plate may be mechanically connected to a plurality of pumps, each pump being a part of the spray head. In an example, the spray head may include two, three, four, five, or six pumps. In some embodiments, the pumps may be reciprocating piston pumps. Each of the pumps may include a proximal and a distal end.

The proximal end of each pump may be mechanically connected to a back pressure plate. More specifically, the back pressure plate may be pressure locked over the proximal end of each of the pumps. Additionally, the back pressure plate may include multiple orifices. In an example, the back pressure plate may include the same number of orifices as there are pumps in the spray head. Each pump may be slideably inserted through an orifice within the back pressure plate. In some embodiments, the back pressure plate may be triangular in shape although other shapes are within the scope of the disclosure.

One or more connectors may be disposed around each orifice within the back pressure plate. Each connector may be configured to reversibly connect the back pressure plate to a proximal end of one of the pumps. In an example, the connectors may be clips. As will be described below, when any one of the nozzles is in the "on" position, the adjacent pump and the back pressure plate move toward the front plate. There is little or no pressure on these connectors and, consequently, they do not disengage the proximal end of the pump from the back pressure plate. Conversely, when the nozzle is in an "off" position, the flow-through pressure through the pump is blocked. The piston within the adjacent pump is unable to move and the pump remains stationary. The back pressure plate moves toward the front plate and negative pressure is applied to the connectors. The connectors release the proximal end of the stationary pump from the back pressure plate. Each of the pumps is inserted through an orifice in the back pressure plate. The back pressure plate slides along the length of the stationary pump as the back pressure plate moves toward the front plate.

The spray head may include a single trigger which may actuate one or more of the pumps when the pump is in fluid connection with a nozzle that is in the "on" position. The trigger may be in connection with the back pressure plate through a trigger pump rod.

The spray head may include a plurality of hoses. Each hose may be in fluid communication with one of the pumps and with one of the nozzles. Each hose may extend downward into one of the containers. The hoses may be connected to the pumps with tube fittings as is known in the art. The spray head may include a pump housing which encloses the pumps, front plate, back pressure plate, connectors, and part of each of the hoses.

A spray handle may be disposed between the spray head and a container release housing. The spray handle may be shaped such that a user may comfortably wrap his or her fingers around the spray handle during use. The spray handle may include an upper end and a lower end. The upper end of the spray handle may be connected to the spray head and the lower end of the spray handle may be connected to the container release mechanism.

The container release mechanism may include a container release housing which may be reversibly connected to the top rim of each of the multiple containers. The top rim may define an opening on each of the containers. The container release housing may include a plurality of orifices which are at least partially defined by a plurality of walls. A lower edge of each wall may include a lip which may partially define one of a plurality of orifices. A container may be pushed upward into each orifice and snap into place as the top rim of the container moves over the lip. The container release mechanism may also include a plurality of release clips each of which may also partially define one of the orifices. Each release clip may similarly snap over the top rim of one of the containers.

The container release mechanism may include a plurality of push buttons each of which causes the release of one the plurality of containers when actuated. In an example, each push button may be in mechanical connection with a release bar which includes a first end and a second end. When a user squeezes the push button inward, the push button may apply inward pressure to the first end of the release bar. The second end of the release bar may apply pressure to a release clip within the container release housing which may partially define an orifice through which a container is inserted. The pressure may push the release clip outward which increases the size of the orifice allowing the container to slide out of the orifice. A spring which extends over each hose may decompress providing additional pressure to push the container out of the orifice.

Figure 2:
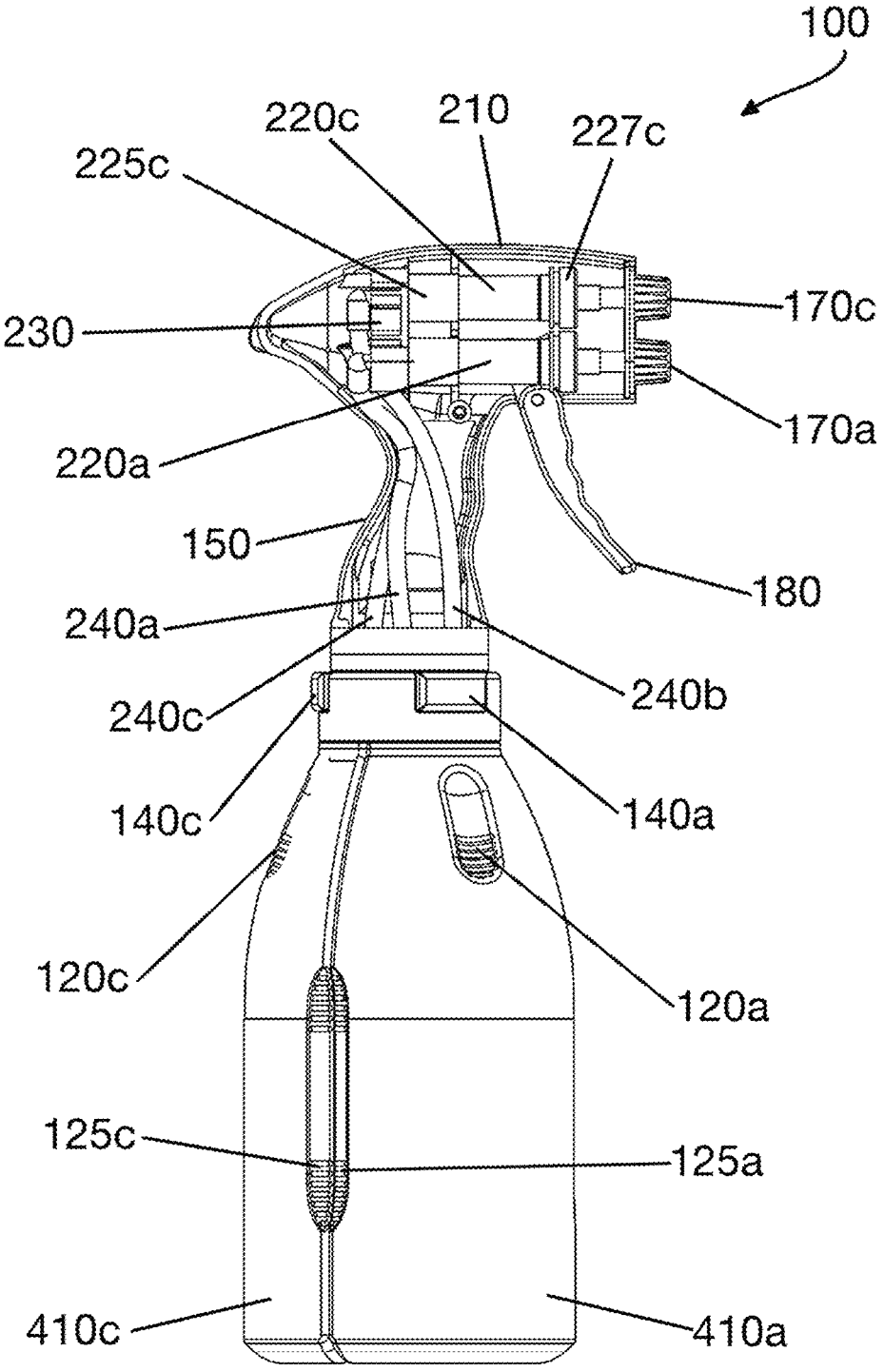
FIG. 2 is a perspective view of the multi-nozzle spray bottle of FIG. 1 with a cross-sectional view of the spray handle and pump housing.
Figure 5:
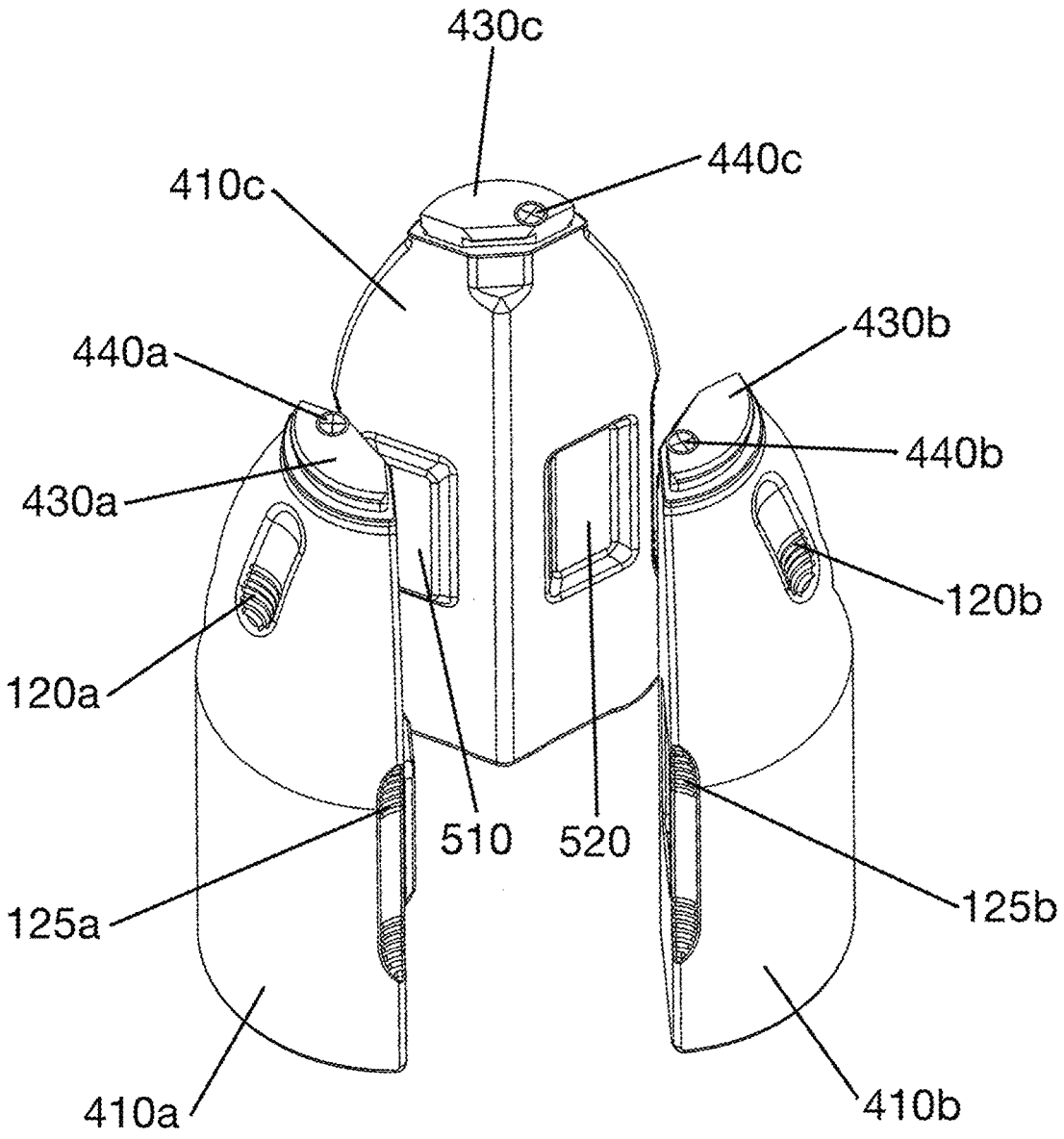
FIG. 5 is an exploded view of a triple-container bottle according to an embodiment of the disclosure.

Referring now to the drawings, FIG. 1 illustrates bottle 100 which is an embodiment of the disclosure. Bottle 100 is a triple-nozzle spray bottle and includes three containers, containers 110*a*, 110*b*, and 110*c*. Bottle 100 further includes finger indentations 125*a*, 125*b*, and 125*c* to which a user may apply his or her fingers during use of bottle 100 and thumb indention 120*a* to which a user may apply his or her thumb during use of bottle 100. Other finger indentations are present in this embodiment but not visible in this view. Thumb indentions 120*b* and 120*c* are present in this embodiment. and not visible in this view. Thumb indentations 120*b* and 120*c* are shown in FIGS. 2 and 5. In this embodiment, finger indentations 125*a*, 125*b*, and 125*c* and thumb indention 120*a* include ridges which may aid in gripping and work flow during use of bottle 100. Container release housing 130 is in connection with the tops of containers 110*a*, 110*b*, and 110*c* and includes push buttons 140*a* and 140*b*, shown in FIGS. 1 and 140*c* which is hidden in this view but visible in FIG. 2. When a user pushes any of push buttons 140*a*, 140*b*, or 140*c*, a spring-loaded mechanism ejects the adjacent container (one of containers 110*a*, 110*b*, and 110*c*). The user may refill or replace the ejected container with another container. Thus, it will be appreciated that container 140*a*, 140*b*, and 140*c* are interchangeable and easily replaced or refilled.

Spray handle 150 extends upward from container release housing 130 and connects the container release housing 130 to spray head housing 210. A user may wrap his or her fingers around spray handle 150 during use of bottle 100. Spray head housing 210 includes nozzles 170*a*, 170*b*, and 170*c* which dispense the fluids which may be housed in containers 110*a*, 110*b*, and 110*c* respectively. As discussed elsewhere herein, each of nozzles 170*a*, 170*b*, and 170*c* may be actuated or blocked at any given time to dispense any combination of fluids in containers 110*a*, 110*b*, and 110*c*. A user may dispense fluids from bottle 100 by squeezing trigger 180 which extends below spray head housing 210.

FIG. 2 illustrates bottle 100 of FIG. 1 and further illustrates a cross-sectional view of the spray handle and spray head. The spray head includes a pump mechanism which is within spray head housing 210. Each of containers 110*a*, 110*b*, and 110*c* is in fluid communication with a pump. In this embodiment, there are three pumps, pumps 220*a*, 220*b*, and 220*c*. Pump 210*c* is not visible in this view but first presented in FIG. 3A. It will be appreciated that a multi-nozzle spray bottle according to the disclosure may have a different number of containers and, accordingly, the same number of pumps. Pumps 220*a*, 220*b*, and 220*c* each include a proximal end and a distal end. Proximal end 225*c* and distal end 227*c* of pump 220*c* are shown. Proximal and distal ends of pump 220*a* are not labeled for purposes of clarity.

Figure 7:
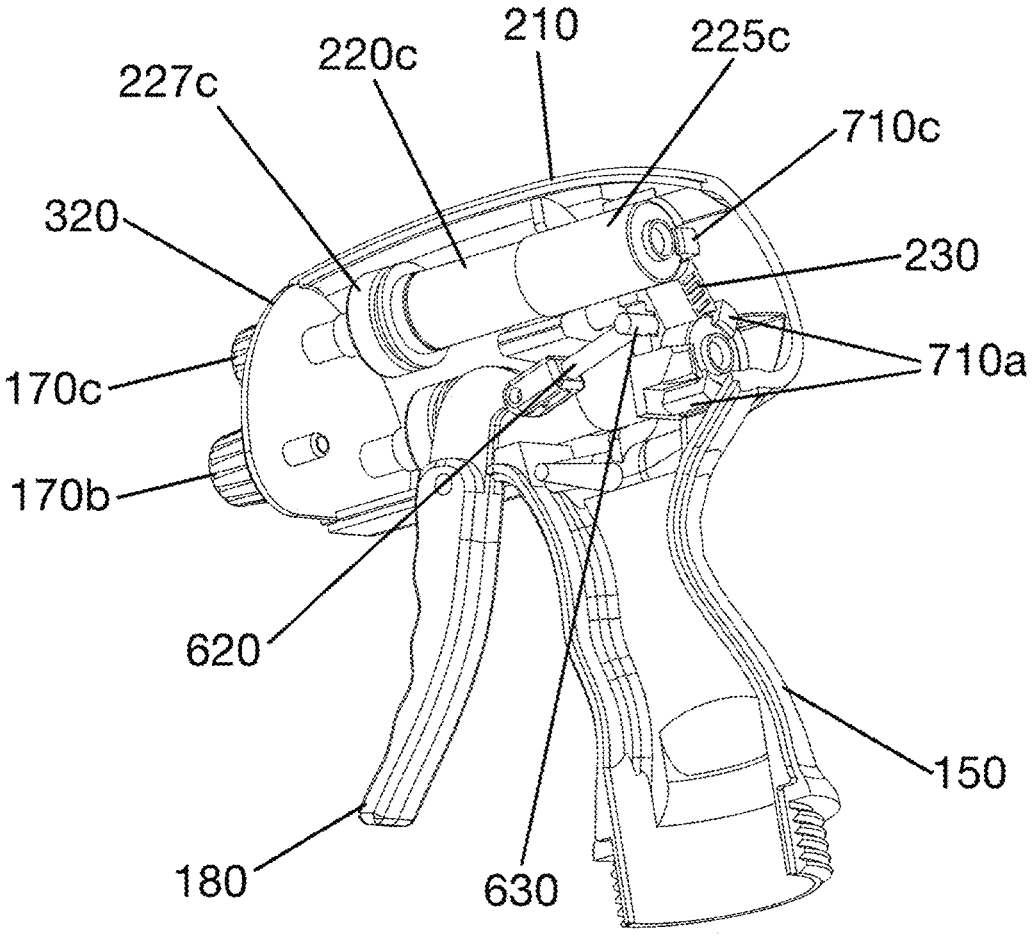
FIG. 7 shows a perspective view of a trigger pump mechanism within a spray head according to an embodiment of the disclosure.

Proximal end 225*c* of pump 220*c*, as well as the proximal ends of the other pumps, are in mechanical connection with back pressure plate 230 and may be reversible attached through connectors. In some embodiments, the connectors may be clips as illustrated in FIG. 7. In this embodiment, back pressure plate 230 is triangular-shaped although one of skill in the art will appreciate that other shapes are within the scope of the disclosure. Back pressure plate 230 may pressure lock over the proximal end of each of each of pumps

220*a*, 220*b*, and 220*c*. In this position, all three of pumps 220*a*, 220*b*, and 220*c* may actuate when trigger 180 is actuated, thus causing fluid from all three of containers 110*a*, 110*b*, and 110*c* to move through the pump mechanism and out one of nozzles 170*a*, 170*b*, or 170*c*. Hoses 240*a*, 240*b*, and 240*c* extend from the proximal end of each of pumps 220*a*, 220*b*, and 220*c* respectively into one of containers 110*a*, 110*b*, and 110*c*. When one or more of pumps 220*a*, 220*b*, and 220*c* is actuated, fluid is drawn from the corresponding container and into the corresponding pump. Fluid drawn from one or more of containers 110*a*, 110*b*, and 110*c* is then dispensed out through one or more of nozzles 170*a*, 170*b*, or 170*c* respectively. Each of nozzles 170*a*, 170*b*, and 170*c* may include one or more of a plain-orifice nozzle, a shaped-orifice nozzle, a surface-impingement single-fluid nozzle, a spiral spray nozzle, a pressure-swirl single-fluid spray nozzle, a spillback nozzle, a solid-cone single-fluid nozzle, or any other single-fluid nozzle known in the art.

Figure 3A:
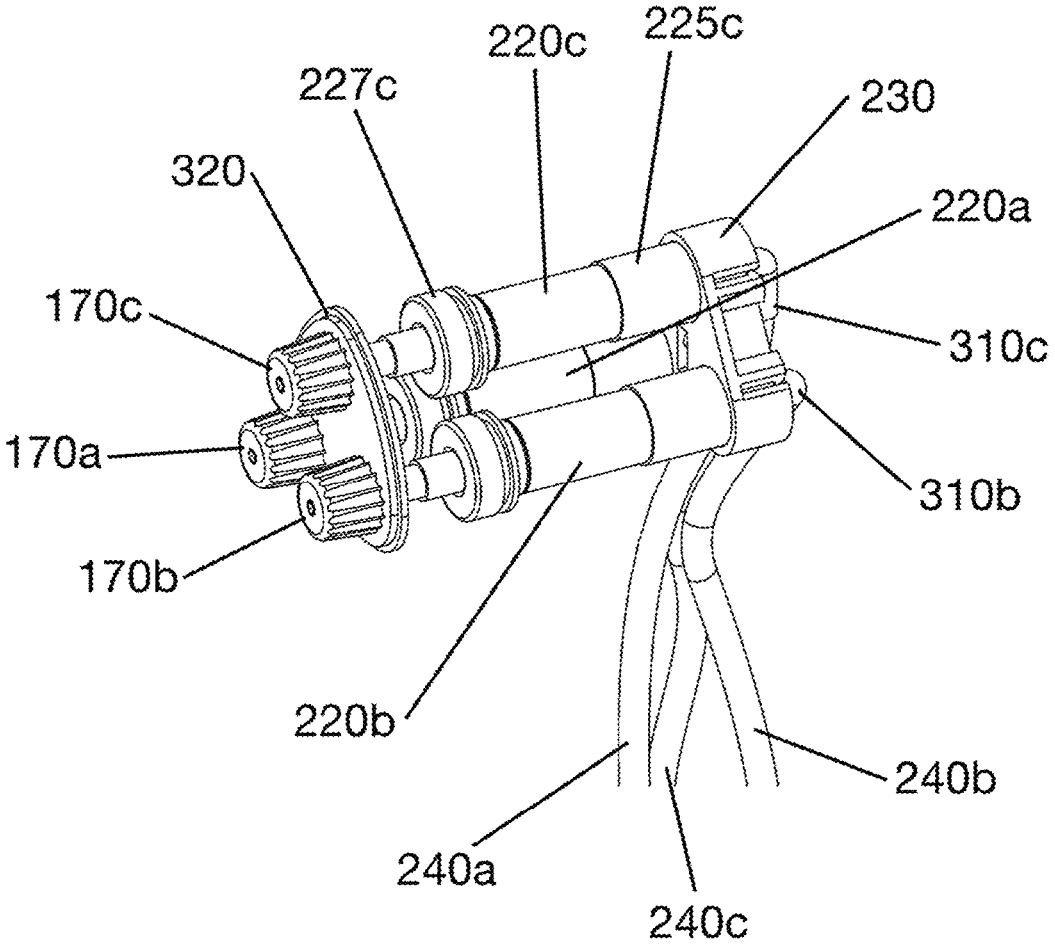
FIG. 3A is a perspective view of a pump mechanism which may be included in an embodiment of the disclosed spray bottle.
Figure 3B:
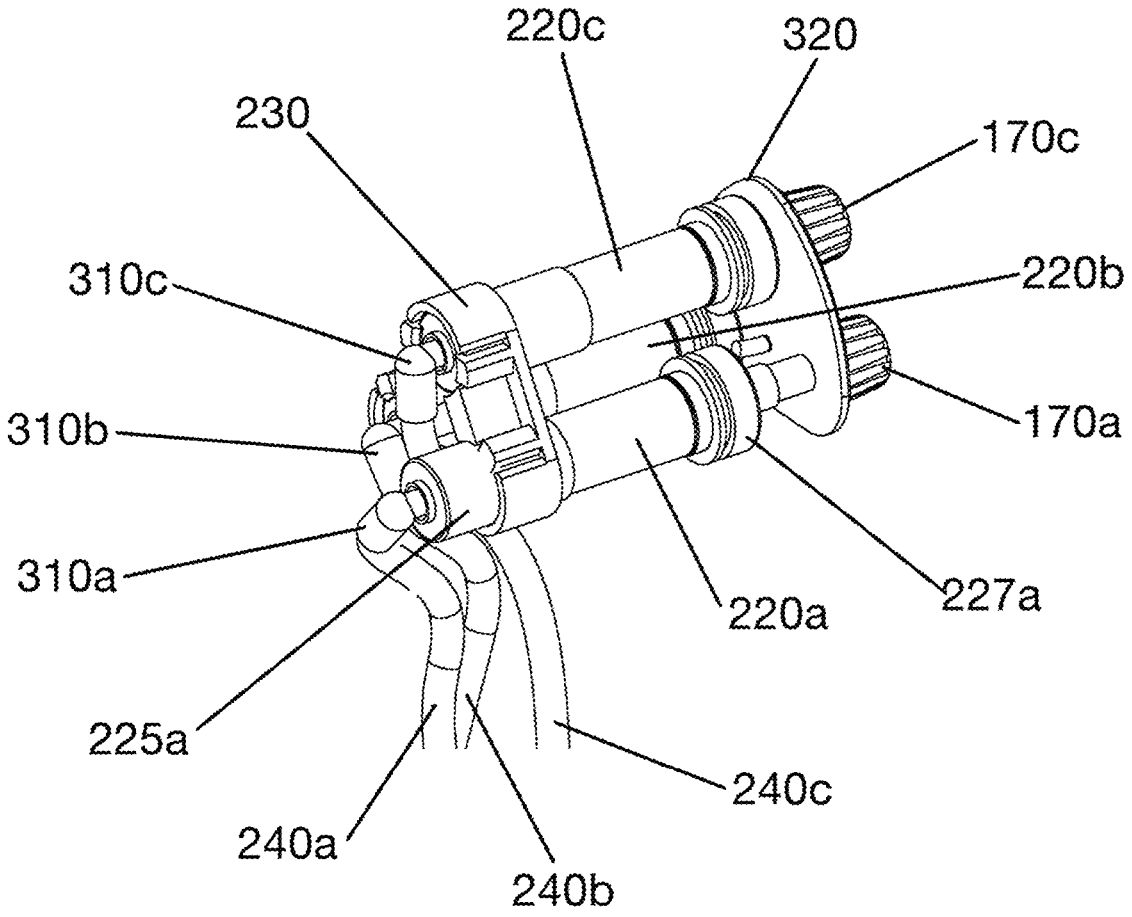
FIG. 3B is a perspective view of the pump mechanism of FIG. 3A illustrating two of the three pumps actuated.

FIGS. 3A and 3B illustrate a close-up view of an embodiment of the pump mechanism. In FIG. 3A, all three of pumps 220*a*, 220*b*, and 220*c* are in an "on" position in which all three of nozzles 170*a*, 170*b*, and 170*c* are open and ready to dispense fluid. Nozzles 170*a*, 170*b*, and 170*c* are in mechanical connection with a first side of front plate 320. Additionally, distal end 227*c* of pump 220*c*, as well as the distal ends of pumps 220*a* and 220*b*, are in mechanical connection with a second side of front plate 320 which is opposite the side in mechanical connection with nozzles 170*a*, 170*b*, and 170*c*.

Back pressure plate 230 includes a plurality of orifices. The proximal end of each of pumps 220*a*, 220*b*, and 220*c* is inserted into one of the plurality of orifices and, when the connectors are engaged, the piston pumps move toward front plate 320 in response to pressure from back pressure plate 230. Tube fitting 310*c* (not visible in this view) connects the proximal end 227*c* of pump 220*c* to hose 240*c*. Likewise, tube fittings 310*a*, and 310*b* connect the proximal ends of pumps 220*a* and 220*b* respectively to hoses 240*a* and 240*b* respectively. In response to the flow-through pressure created by actuating all three pumps, fluid may be drawn through hoses 240*a*, 240*b*, and 240*c*, through the pump mechanism and out through nozzles 170*a*, 170*b*, and 170*c*.

In FIG. 3B, nozzle 170*a* has been turned to an "off" position which blocks the flow-through pressure and thereby blocks the flow of fluid through the sections of the pump mechanism which are in fluid communication with nozzle 170*a*. The connectors which reversibly connect back pressure plate 230 to proximal end 225*a* of pump 220*a* have been disengaged. Consequently, when trigger 180 is actuated and back pressure plate 230, moves toward front plate 320, pump 220*a* does not move toward front plate 320 along with pumps 220*b* and 220*c*. Rather, back pressure plate 230 moves lengthwise along pump 220*a* toward its distal end 227*a* as pump 220*a* passes through an orifice in back pressure plate 230. While pumps 220*b* and 220*c* move toward front plate 320 drawing fluid through hoses 240*b* and 240*c*, pump 220*a* remains relatively motionless and no fluid moves through hose 240*a*.

Figure 4:
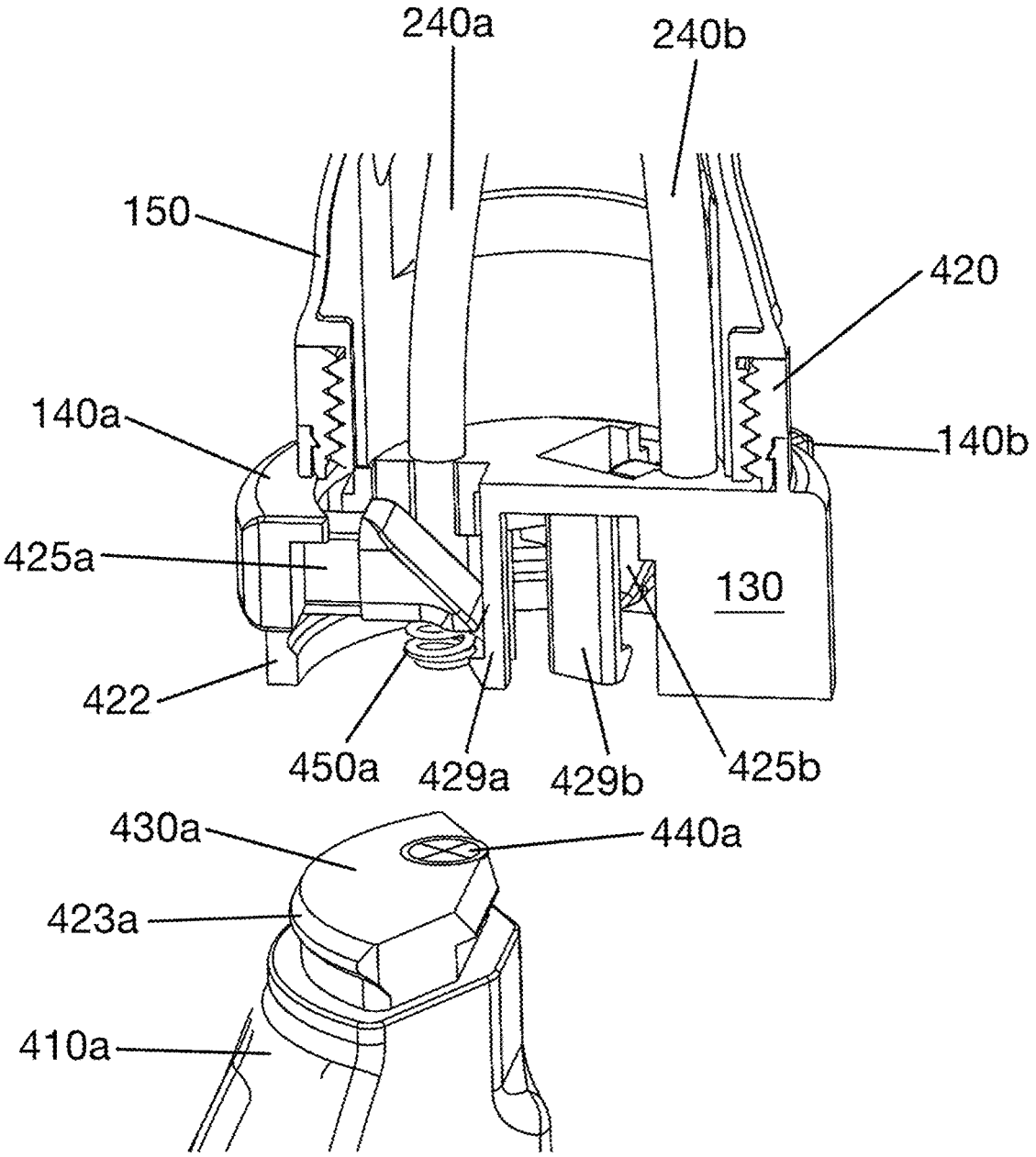
FIG. 4 includes a cross-sectional view of a container release mechanism and a perspective view of a container of a triple-container bottle according to an embodiment of the disclosure.

FIG. 4 illustrates a close up view of a container release mechanism which may be included in an embodiment of the disclosed multi-nozzle multi-container fluid spray device. Container 410*a* is also shown which is an embodiment of one of a plurality of disposable and/or replaceable containers which may be included in an embodiment of the disclosed multi-nozzle multi-container fluid spray device.

Container release housing 130 houses parts which function to reversibly connect a spray handle (in this embodiment, spray handle 150 originally presented in FIG. 1) to the plurality of containers which includes container 410*a*. Container release housing 130 includes threaded locking ring 420 which connects container release housing 130 to spray handle 150. Lip 422*a* and container clip 429*a* at least partially define one of a plurality of orifices. Top rim 423*a* of container 410*a* may be pushed through the orifice and beyond lip 422*a* and container clip 429*a*. Lip 422*a* and container clip 429*a* may then snap back in place securing the top rim 423*a* above lip 422*a* and container clip 429*a*.

Container release housing 130 also includes push button 140*a* which is in mechanical connection with release bar 425*a*. Likewise, push button 140*b* is in mechanical connection with release bar 425*b* which, in turn, is in mechanical connection with container clip 429*b*. In summary, each push button on the disclosed device may be in mechanical connection with a release bar and a container may be secured by sliding a top rim of a container over an associated lip and container clip. An example of a mechanism through which container 410*a* may be inserted and released is described below. A container may be released by actuating push button 140*b* when corresponding parts participate in the same mechanism.

A container clip holds each container in place by clipping under the top rim of each container. FIG. 4 shows container clip 429*a* which may help to secure container 410*a* when container 410*a* is inserted into the container release mechanism. As shown, container clip 429*a* compresses container ejector spring 450*a*. When container 410*a* is inserted into the container release mechanism, container clip 429*a* may slip under top rim 423*a* of container 410*a* at the inner most section of top rim 423*a*. The opposite side of top rim 423*a* may also slip under lip 422*a*. Container ejector spring 450 continues to be compressed and applies pressure to seal 430*a* which helps to secure seal 430*a* to container 410*a*.

When a user desires to release or replace container 410*a*, the user may squeeze push button 140*a* inward which applies inward pressure to a first end of release bar 425*a*. Push button 140*a* thereby moves from a first position to a second position (left to right as shown in FIG. 4) and causes release bar 425*a* to move from a first position to a second position (also left to right as shown in FIG. 4). The second end of release bar 425*a* applies lateral pressure to container clip 429*a*. Container clip 429*a* releases ejector spring 450*a* which extends downward pushing container 410*a* downward, thus ejecting container 410*a*.

Container 410*a* includes seal 430*a* over the opening of container 410*a*. Seal 430*a* includes hose receptacle 440*a*. When container 410*a* is snapped into container release housing 130 as described above, hose 240*a* may insert through hose receptacle 440*a* and thus descend into container 410*a*. Ejector spring 450*a* slides around tube 240*a*. When container 410*a* is inserted into the container release mechanism, ejector spring 450*a* is compressed and aids in securing top rim 423*a* of container 410*a* tightly against seal 430*a*.

FIG. 5 illustrates an exploded view of three containers, containers 410*a*, 410*b*, and 410*c*, which may be included in an embodiment of the disclosed device. FIG. 5 includes container 410*a*, part of which was originally presented in FIG. 4. Containers 410*b* and 410*c* are similar or identical to container 410*a*.

As shown in FIG. 5, containers 410*a*, 410*b*, and 410*c* may be separated from each other. Container 410*a* includes seal 430*a* and hose receptacle 440*a*, container 410*b* include seal

430*b* and hose receptacle 440*b*, and container 410*c* includes seal 430*c* and hose receptacle 440*c*. Thumb indentations 120*a* and 120*b* as well as finger indentations 125*a* and 125*b* are visible in this view. Male notch 510 and female notch 520 are shown on container 410*c*. While not visible, containers 410*a* and 410*b* also include a male notch and a female notch. Male notch 510 on container 410*a* may insert into a female notch on containers 410*b* and 410*c*. Likewise, the male notches on containers 410*b* and 410*c* may insert into female notch 520 on container 410*a*.

Figure 6A:
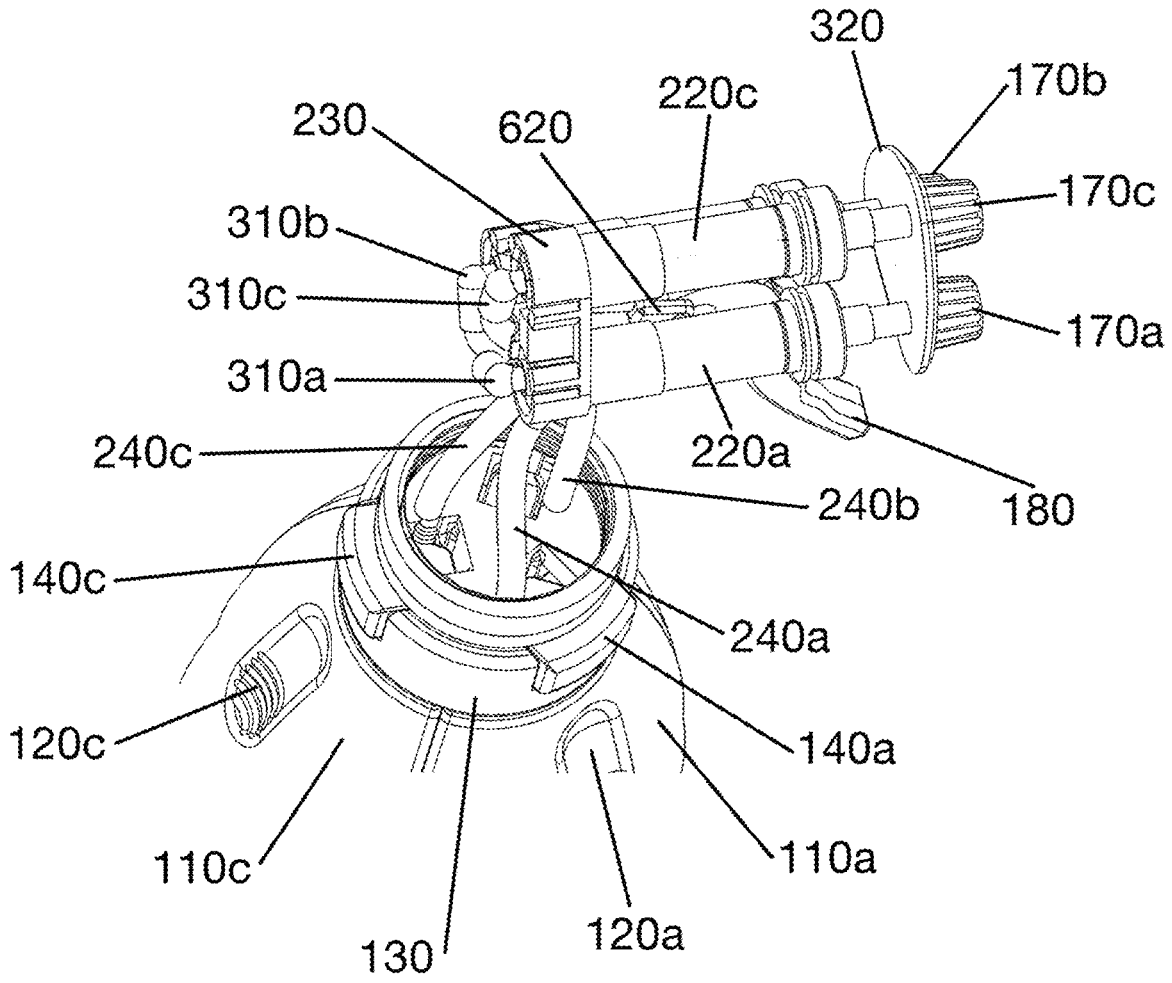
FIG. 6A is an elevated perspective view of a pump mechanism, hoses, and three combined containers according to an embodiment of the disclosure.

FIG. 6A illustrates a pump mechanism being inserted into three containers which have been connected to each other. The pump housing and container release housing are not shown so that the viewer may visualize the parts of the pump mechanism. The pump mechanism of FIG. 6A is as shown in FIGS. 3A and 3B. Trigger 180 is in mechanical connection with trigger pump rod 620 which, in turn is in mechanical communication with back pressure plate 230. Trigger pump rod 620 pulls back pressure plate 230 forward toward front plate 320 when trigger 180 is engaged. Hoses 240*a*, 240*b*, and 240*c* extend into containers 410*a*, 410*b*, and 410*c* respectively. Each of hoses 240*a*, 240*b*, and 240*c* insert into hose receptacles 440*a*, 440*b*, and 440*c* respectively as originally presented in FIG. 4.

Figure 6B:
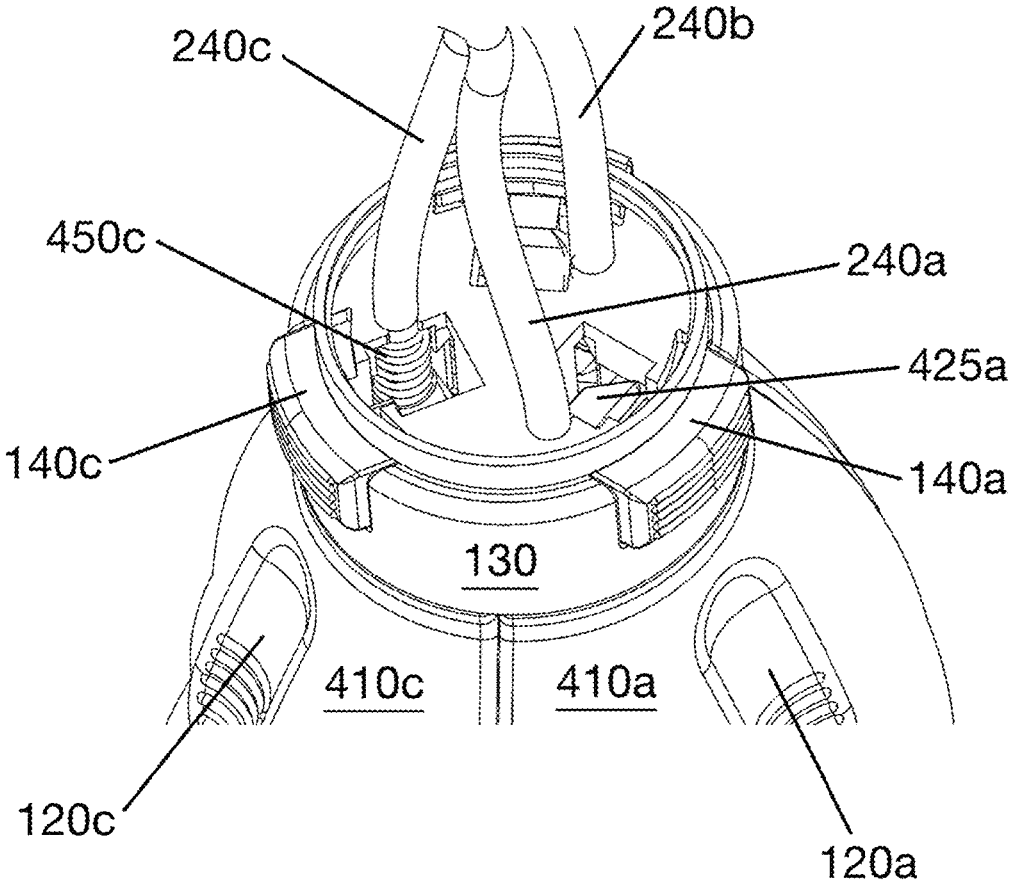
FIG. 6B is a close-up view of the hoses in FIG. 6A entering the three combined containers.

FIG. 6B is a close-up view of hoses 240*a*, 240*b*, and 240*c* entering three combined containers through hose receptacles 440*a*, 440*b*, and 440*c* respectively as illustrated in FIG. 5. Ejector spring 450*c* is shown extending over hose 240*c*.

FIG. 7 shows the trigger pump mechanism within a spray head according to an embodiment of the disclosure. Trigger 180 is in mechanical connection with trigger pump rod 620 which, in turn, is connected to connecting pivot 630. Connecting pivot 630 inserts into a slot on back pressure plate 230 and may pivot within its slot to allow for movement but still maintain a constant connection with back pressure plate 230. This mechanism may prevent slippage and possible catching or other types of malfunction when trigger 180 is actuated and pump rod 620 applies pressure to back pressure plate 230.

Pump clips secure each of pumps 220*a*, 220*b*, and 220*c* to back pressure plate 230. FIG. 7 shows pump clip 710*c* in connection with proximal end 225*c* of pump 220*c*. Similarly, pump clip 710*a* is in connection with pump 220*a*. Each pump clip holds its corresponding pump in an engaged position when the pump is being activated. When one or more of nozzles 170*a*, 170*b*, or 170*c* is turned to the "off" position, the flow-through pressure to the corresponding pump is blocked. The pump clips in connection with the corresponding pump are released when trigger 180 is actuated and the pump clips are allowed to disengage from the corresponding pump. Back pressure plate 230 is free to move over the corresponding pump which remains stationary. This mechanism provides full flexibility and customization of the nozzle spray settings.

Figure 8:
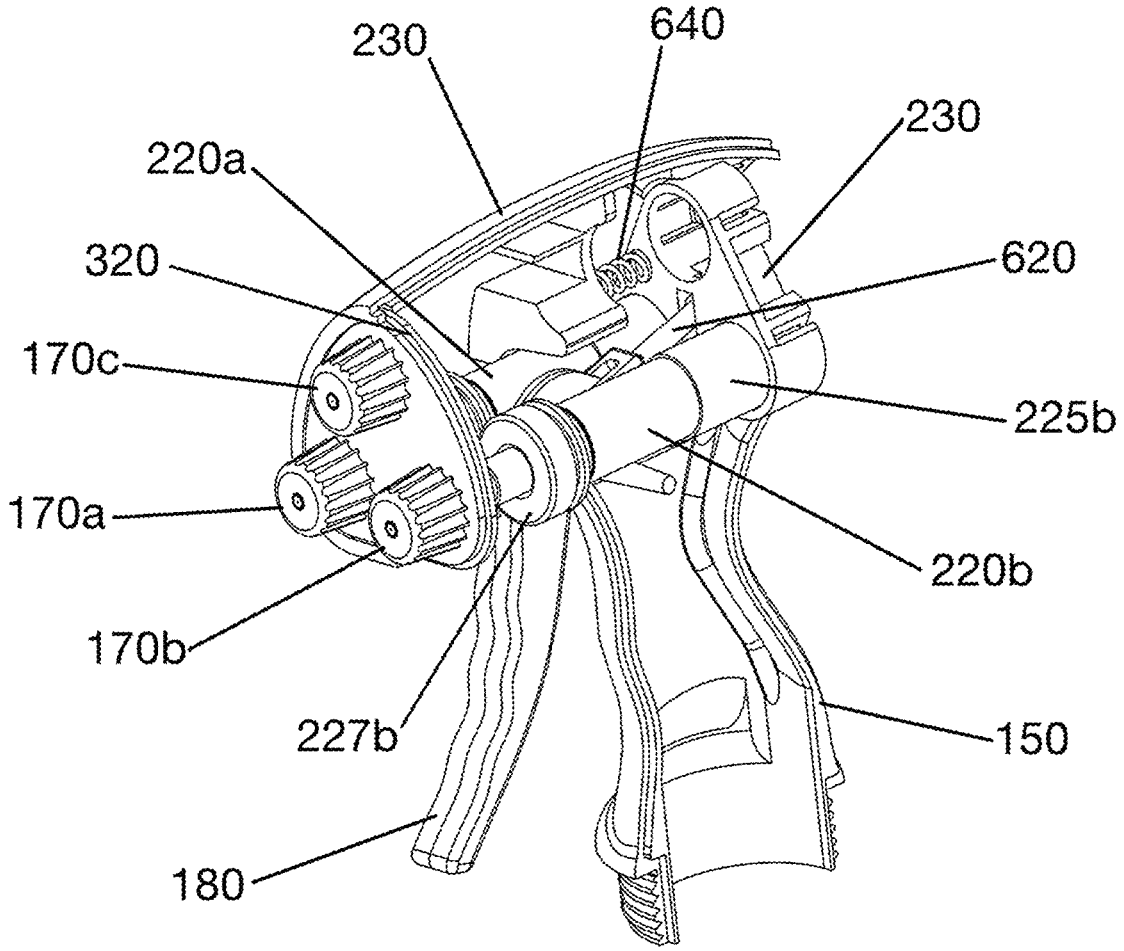
FIG. 8 shows a perspective view of a trigger pump mechanism within a spray head in which the back pressure plate may return to its starting position after the trigger has been actuated according to an embodiment of the disclosure.

FIG. 8 illustrates the mechanism through which back pressure plate 230 returns to its starting position after trigger 180 has been actuated in a situation in which all three of nozzles 170*a*, 170*b*, and 170*c* are turned to the "off" position. Pump 220*b* with its proximal end 225*b* and distal end 227*b* are shown. Pump 220*c* is omitted for purposes of clarity. When all three of nozzles 170*a*, 170*b*, and 170*c* are turned to the "off" position, the flow-through pressure through pumps 210*a*, 210*b*, and 210*c* is blocked. When trigger 180 is actuated, the trigger pump mechanism described above and illustrated in FIG. 7 moves back pressure plate 230 forward toward front plate 320. As it moves, back pressure plate 230 compresses return spring 640 creating tension. When trigger 180 is disengaged, return spring 640 releases the tension and decompresses, thus returning back pressure plate 230 to its starting position.

While specific embodiments have been illustrated and described above, it is to be understood that the disclosure provided is not limited to the precise configuration, steps, and components disclosed. Various modifications, changes, and variations apparent to those of skill in the art may be made in the arrangement, operation, and details of the methods and systems disclosed, with the aid of the present disclosure.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the disclosure herein.

We claim:

1. A multi-nozzle multi-container fluid spray device comprising:

a plurality of reversibly connectable containers, wherein each of the plurality of reversibly connectable containers comprises an opening defined by a top rim;

a spray head, wherein the spray head is in reversible mechanical communication with the plurality of reversibly connectable containers, and wherein the spray head comprises:

a plurality of pumps, each of the plurality of pumps comprising a proximal end and a distal end;

a back pressure plate, comprising:

a plurality of orifices through which each of the plurality of pumps is slidably inserted;

a plurality of connectors, the plurality of connectors in reversible mechanical connection with the plurality of pumps;

wherein each of the plurality of connectors is configured to reversibly attach the back pressure plate to the proximal end of one of the plurality of pumps;

a plurality of nozzles, each of the plurality of nozzles in fluid communication with the distal end of each of the plurality of pumps; and a single trigger, wherein the single trigger is in mechanical connection with the back pressure plate; and a plurality of hoses, each in fluid communication with one of the plurality of pumps and one of the plurality of nozzles, and each extending into one of the plurality of reversibly connectable containers; and a spray handle;

wherein the spray handle comprises a top end and a bottom end;

wherein the top end of the spray handle is in mechanical connection with the spray head; and wherein the bottom end of the spray handle is reversibly connected to a container release mechanism, the container release mechanism further comprising:

a container release housing comprising;

a plurality of walls;

a lip disposed at the lower edge of the plurality of walls;

a plurality of release bars;

a plurality of release clips; and a plurality of push buttons;

wherein each of the plurality of push buttons is in mechanical connection with one of the plurality of release bars; and wherein each of the plurality of release bars is in mechanical connection with one of the release clips.

2. The multi-nozzle multi-container fluid spray device of claim 1, wherein the plurality of pumps comprises at least one reciprocating piston pump.

3. The multi-nozzle multi-container fluid spray device of claim 1, further comprising a return spring, wherein the return spring is in mechanical connection with the back pressure plate and is disposed between the back pressure plate and the plurality of nozzles.

4. The multi-nozzle multi-container fluid spray device of claim 1, wherein each of the plurality of nozzles is configured to independently open and close.

5. The multi-nozzle multi-container fluid spray device of claim 1, wherein the plurality of reversibly connectable containers consists of three containers.

6. The multi-nozzle multi-container fluid spray device of claim 1, wherein each of the plurality of reversibly connectable containers is independently selected from the following list: bottles, tubes, sleeves, flasks, jars, packets, cans, and drums.

7. The multi-nozzle multi-container fluid spray device of claim 1, wherein each of the plurality of reversibly connected containers comprises a male notch and a female notch, wherein the male notch of each of the plurality of reversibly connected containers is configured to reversibly insert into the female notch of an adjacent reversibly connected container within the plurality of containers.

8. The multi-nozzle multi-container fluid spray device of claim 1, wherein each opening on each of the plurality of containers is covered by a seal, wherein the seal comprises a hose receptacle through which one of the plurality of hoses is reversibly inserted.

9. The multi-nozzle multi-container fluid spray device of claim 1, wherein the container release mechanism further comprises a spring-loaded mechanism.

10. The multi-nozzle multi-container fluid spray device of claim 1, wherein the plurality of push buttons consists of three push-buttons.

11. The multi-nozzle multi-container fluid spray device of claim 1, wherein at least one of the plurality of containers is disposable, replaceable, biodegradable, or refillable.

12. The multi-nozzle multi-container fluid spray device of claim 1, wherein each of the plurality of nozzles is independently selected from the following list: a plain-orifice nozzle, a shaped-orifice nozzle, a surface-impingement single-fluid nozzle, a spiral spray nozzle, a pressure-swirl single-fluid spray nozzle, a spillback nozzle, and a solid-cone single-fluid nozzle.

13. The multi-nozzle multi-container fluid spray device of claim 1, wherein each of the plurality of connectors is configured to reversibly release the proximal end of one of the plurality of pumps in response to the application of negative pressure to the connector.

14. The multi-nozzle multi-container fluid spray device of claim 1, wherein each of the plurality of connectors is configured to reversibly fasten the proximal end of one of the plurality of pumps to the back pressure plate in response to the application of positive pressure to the connector.

15. The multi-nozzle multi-container fluid spray device of claim 1, wherein at least one of the plurality of connectors comprises a pump clip.

16. The multi-nozzle multi-container fluid spray device of claim 1, wherein each of the plurality of nozzles is adjustable to deliver a range of densities of fluid particles.

17. The multi-nozzle multi-container fluid spray device of claim 1, wherein the back pressure plate is triangular shaped.

18. The multi-nozzle multi-container fluid spray device of claim 1, wherein the back pressure plate is pressure locked over the proximal end of each of the plurality of pumps.

* * * * *